United States Patent [19]

Paige

[11] 4,056,299

[45] Nov. 1, 1977

[54] ELECTRICAL CONNECTOR

[75] Inventor: Walter Griffin Paige, Pasadena, Calif.

[73] Assignee: Burroughs Corporation, Detroit, Mich.

[21] Appl. No.: 682,770

[22] Filed: May 3, 1976

[51] Int. Cl.[2] ..... H01R 13/38

[52] U.S. Cl. ..... 339/95 D; 339/113 R; 339/218 R

[58] Field of Search ..... 339/95, 113, 184, 185, 339/191-193, 276 F, 276 SF, 277, 218

[56] References Cited

U.S. PATENT DOCUMENTS

| | | | |
|---|---|---|---|
| 2,350,765 | 6/1944 | Johnson | 339/276 F |
| 2,811,705 | 10/1957 | Schumacher | 339/277 R |
| 3,022,480 | 2/1962 | Tiffany | 339/95 A |
| 3,519,977 | 7/1970 | Swearingen | 339/185 R |
| 3,566,341 | 2/1971 | Skony | 339/192 RL |
| 3,622,954 | 11/1971 | Hovnanian | 339/95 A |
| 3,777,301 | 12/1973 | Michaels | 339/277 R |
| 3,980,388 | 9/1976 | Nailor | 339/184 R |

FOREIGN PATENT DOCUMENTS

| | | | |
|---|---|---|---|
| 1,251,400 | 10/1967 | Germany | 339/95 D |

*Primary Examiner*—Joseph H. McGlynn

*Attorney, Agent, or Firm*—Alfred W. Kozak; Nathan Cass; Kevin R. Peterson

[57] ABSTRACT

A simple inexpensive electrical connector (and method of fabrication) for the connection of twisted pair or coaxial cable wires to adjacent pins extending from a backplane. A thin metallic strip is punched to form a plurality of pairs of flags extending from a common connector strip. The distance between the two flags of each pair is regulated to match the standard distance between terminal pins of the backplane. Each flag is punched with a central opening which forms teeth therein. The flags are preferably bent at the perimeter areas in order to form stiffening flanges and means for wire connection. Alternatively the flags are preferably encompassed by stiff plastic insulating material after the lead wires have been connected to each flag. A common connector strip which may be broken off and discarded, is used for handling with automatic equipment. A solid, reliable, durable and gastight connection is accomplished by pressing the connector over a pair of adjacent terminal pins which are bitten into by the toothed projections of the inner openings of each flag. Servicing and orderliness is facilitated since multiple sets of connectors can also be stacked on the same pair of terminal pins.

2 Claims, 6 Drawing Figures

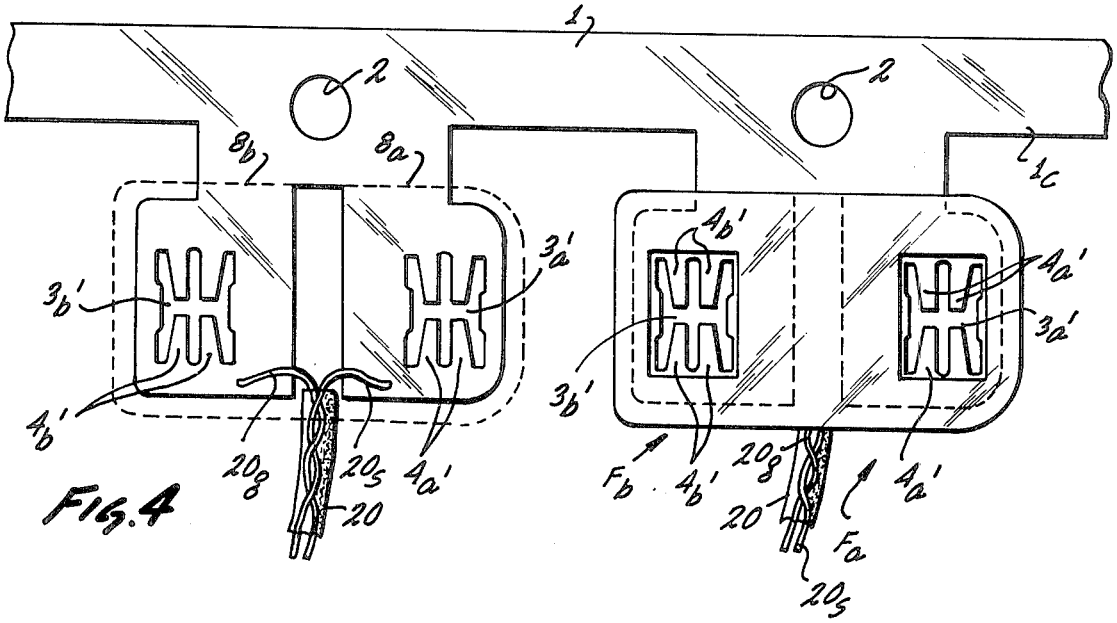
FIG. 4
FIG. 5
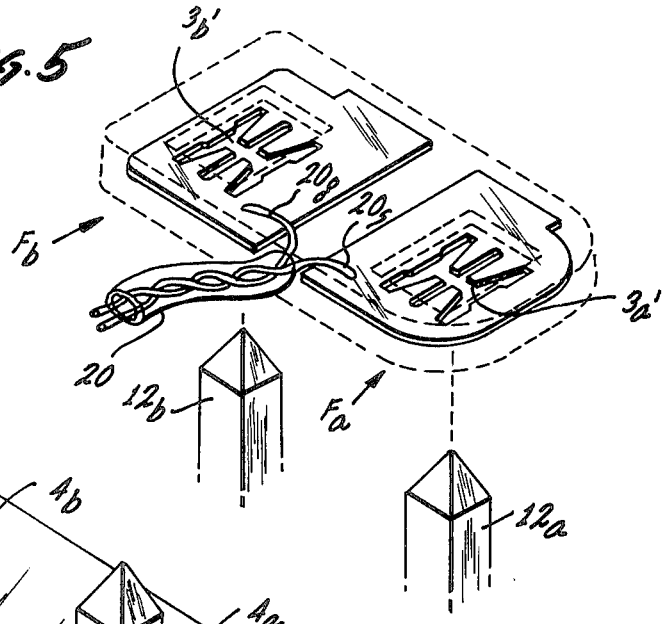
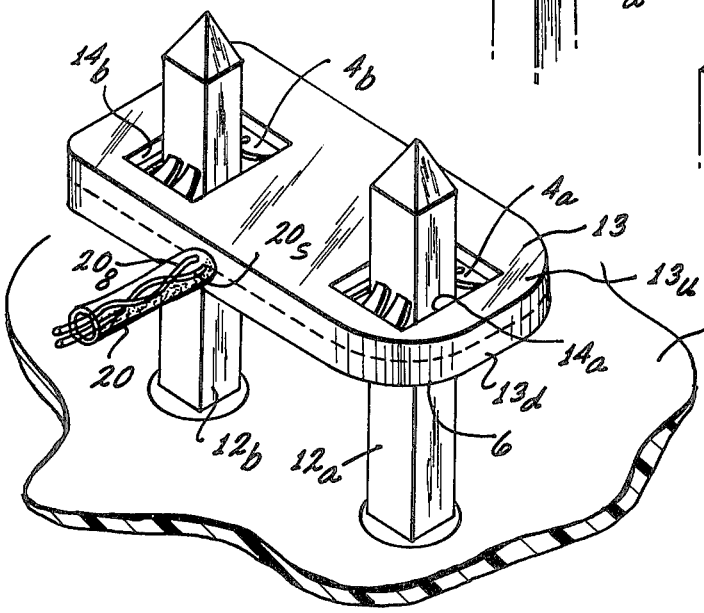
FIG. 6

ELECTRICAL CONNECTOR

FIELD OF THE INVENTION

This invention involves the field of electrical hardware, particularly electrical hardware designed for electrical connections and suited for connecting twisted pair and coaxial cable wires to high density computer circuitry, especially at the backplane.

BACKGROUND OF THE INVENTION

In present computer systems it is common practice to use base plates, often called motherboards, which hold multitudes of electrical terminals extending outward from a plane. This area is generally called the "backplane" or backplane grid. The backplane terminals are protruding pins which are usually of the "wire-wrap" type, which means they are spaced and arranged to permit connecting wire to be wrapped onto the pins by means of hand wrapping, motor assist wrapping, or automatic wiring machine techniques, such as by Gardner-Denver wire-wrap machines.

The problem often arises when coaxial or twisted pair cable is used in the backplane of certain computers. When using these twisted pair or coaxial lines it is not, at this time, feasible to use the automatic wire wrapping machines such as the Gardner-Denver to handle low impedance conductors as required for high speed computers. With the twisted pair, two leads are typically used, one of which is a signal lead and the other a ground lead (or drain lead). Likewise, coaxial cables have a central signal lead and an outer ground lead.

Methods have been developed whereby a motor driven machine having a two-barreled spinner is used to make wire-wrap connections on two terminals at the same time, but this process is complex and involves skillful manual operations which consume time.

Thus the manufacturer of computers and the wiring technician is faced with the problem of how to efficiently arrange to connect the two leads of the coax cable or twisted pair onto adjacent terminal pins on the backplane of the computer; a further part of the problem involves the ability to economically produce suitable connectors in large quantities, preferably using automatic equipment.

Prior art connectors usually connected to backplane pins such that the planar face of the connector was perpendicular to the face of the backplane. Thus no stacking or "nesting" of connectors on the same pair of backplane pins could be effectuated.

SUMMARY OF THE INVENTION

The present invention for connecting coaxial cable or twisted pair wire to the backplane terminals of a computer may have several embodiments.

The first, most simple and economical embodiment involves taking a thin flat strip of conductive metal and stamping (or etching) out metallic flag portions having a central opening in each flag such that a plurality of teeth projections are set up in each opening arranged so that the teeth will bite into the surface of the wire-wrap pins on the backplane when the opening is pushed home over the pin. These flag portions are fabricated or punched from a single piece of metallic plate and are held spaced apart (to conform to the grid of terminal pins on a backplane) by a "throwaway" metallic strip which regulates the spatial distance between flag portions. Each flag becomes a connector element. A portion of the flag is provided with two flanges, one of which is rounded and used, when bent upward, to strengthen the face of the connector, while the other flange is used for crimping (or soldering) the lead wire of the twisted pair cable, to the appropriate connector. After connection of the lead wires to the pair of (two) push-home connectors, the whole unit may be encapsulated. The "carrier" or "throwaway" strip facilitates handling by automatic machinery, after which it is broken off and discarded.

In another embodiment of the invention, the flag-connectors for wiring twisted pair or coax leads to the backplane of the computer are fabricated by punching out a series of "pairs of flags" which extends from a common "carrier" strip, and where each of the flags are punched so as to provide one pair of teeth opposite another pair of teeth. In this embodiment the leads of the twisted pair are soldered, welded or brazed to the respective metallic portions of the flags (rather than crimped on as in the previous embodiment). Then the flags are encompassed by a rectangular plastic insulating cover which encloses each pair of flags and also maintains the proper grid spacing between the openings of the flag-pair. The plastic enclosing cover also has cut-outs which align with the openings in each flag-pair permitting the teeth areas to be pushed over an adjacent pair of terminal pins on the backplane.

After the metal flags are sandwiched between the insulating plastic covers and sealed, then the connector (with its two internal flags sandwiched therebetween) can be broken off from the common metallic strip which had provided support and spacing therebefore. When connected to the backplane terminal pins, the teeth of each flag bite into the pin to make a gastight or airtight metallic interconnection which is not subject to corrosion.

BRIEF DESCRIPTION OF THE DRAWINGS

FIGS. 1, 2 and 3 refer to a firsst embodiment of the invention in which:

FIG. 1 is a top view of a metallic strip which has been stamped or punched to form a pair of flags with a common carrier strip.

FIG. 2 is a schematic view of the flags having their curved portion and their straight portion bent at 90° angles to form flanges.

FIG. 3 is a schematic in perspective of a computer backplane showing the terminal pins mounted thereon and extending therefrom.

FIGS. 4, 5 and 6 designate a second embodiment of the invention in which:

FIG. 4 is a metallic strip showing pairs of flags which are held by a common carrier strip.

FIG. 5 is an expanded view in detail of a pair of the punched out flags.

FIG. 6 is a view in perspective of the flags encompassed by an insulator cover and placed into connective relationship with a pair of terminal pins on a backplane.

DESCRIPTION OF THE PREFERRED EMBODIMENTS

Figure 1:
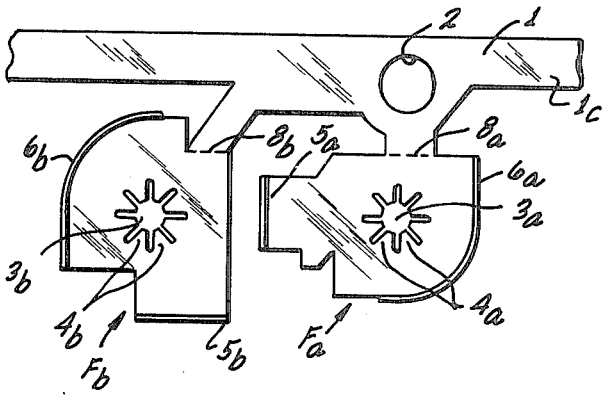
Figure 2:
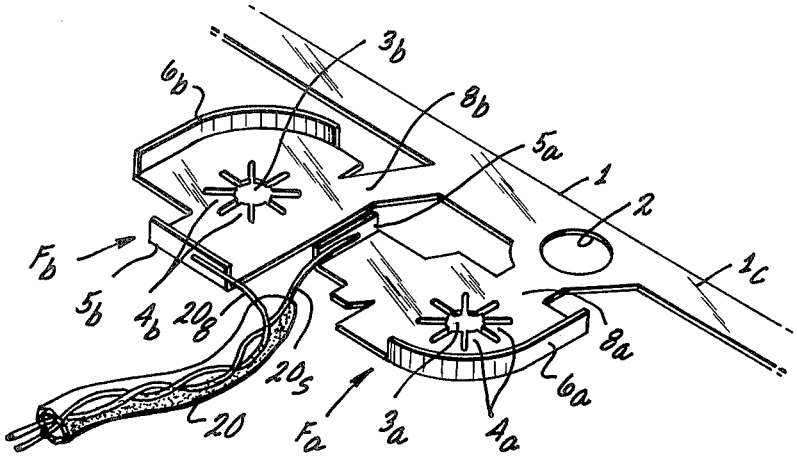
Figure 3:
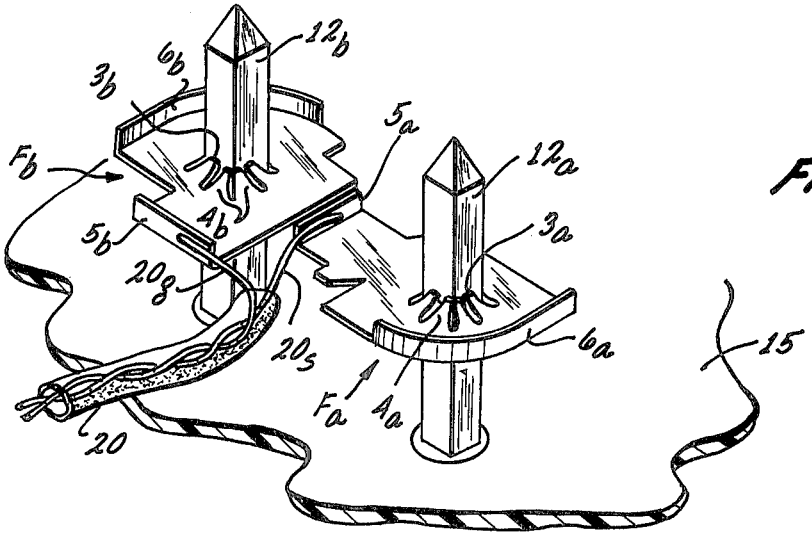

One preferred embodiment of the invention is shown in FIGS. 1, 2 and 3, while a second preferred embodiment of the invention is shown in FIGS. 4, 5 and 6.

Referring to FIGS. 1 and 2, there is seen a metal blank 1 (originally in the form of a thin strip of metal) having tooling holes 2.

The metallic strip 1 is punched in order to form a pair of flags $F_a$ and $F_b$ which are co-joined by a common carrier strip area $1_c$. A large number of such flag pairs are punched in one metallic strip and all have a common carrier portion $1_c$.

The first flag $F_a$ is a metallic portion having a rounded edge $6_a$ and an extension strip $5_a$. In the approximate center there is punched an opening $3_a$ having teeth $4_a$. Likewise, the second flag $F_b$ has a rounded edge $6_b$ and a strip extension $5_b$. In the center of this flag is an opening $3_b$ having teeth $4_b$.

As seen in FIG. 2 the rounded portions $6_a$ and $6_b$ and the extension strips $5_a$ and $5_b$ are bent at 90° in order to form flanges wherein one lead of the coax cable or twisted pair cable is connected to flange $5_a$ (done by soldering or by crimping down the flange $5_a$) and the other lead of the twisted pair is connected to flange $5_b$ in a similar fashion. The rounded portions $6_a$ and $6_b$ are bent to form flanges which serve to provide a stiffening and solidifying of the connector structure. The cable 20 is seen having a signal lead $20_s$ and ground lead $20_g$ connected, respectively, to flanges $5_a$ and $5_b$.

FIG. 3 illustrates in perspective how the pushhome connectors of FIG. 2 may be placed over the backplane terminal pins $12_a$ and $12_b$, during which time the carrier strip $1_c$ maintains the proper spatial distance between the flags so that they will readily match the grid spacing between terminal pins $12_a$ and $12_b$. The central openings $3_a$ and $3_b$ are made just barely less than the size of the terminal pins $12_a$ and $12_b$ so that the pair of connectors may be pushed on and slid down the sides of the terminal pins $12_a$ and $12_b$, while at the same time the teeth $4_a$ and $4_b$ (FIG. 1) will respectively engage or "bite" into the respective terminal pins $12_a$ and $12_b$. This bite forms an electrical interconnection not subject to corrosion since the bite interface is airtight as a result of the harder tooth cutting into the softer terminal pin. The backplane for holding the terminal pins 12 is shown as the backplane board 15.

In one typical area of application, the normal backplane pins are four-hundredths of an inch square, and the inner diameter of the openings $3_a$ and $3_b$ may be equal to or slightly less than a diameter distance for four-hundredths of an inch. This will ensure that fractional contact and biting of the teeth will occur against the terminal pins such as $12_a$ and $12_b$.

Referring again to FIG. 1, the break-off areas $8_a$ and $8_b$ have scored lines wherein, after encapsulation, the carrier portion $1_c$ is broken off and discarded.

A second preferred embodiment of the invention is shown in FIGS. 4, 5 and 6.

Referring to FIG. 4, a thin metal strip 1 has been punched to provide pairs of flags $F_a$ and $F_b$ having central openings $3_a$ and $3_b$. Within the central opening format there is provided a pair of teeth $4_a$ and a pair of opposing teeth $4_a'$. Likewise, in flag $F_b$, there is provided a pair of teeth $4_b$ which are opposed by a pair of teeth $4_b'$. Both flags are connected by a common carrier portion $1_c$ having tooling holes 2.

A twisted pair cable 20 is shown having a ground lead $20_g$ and a signal lead $20_s$. Per arbitrary convention the "ground" lead is connected to the flag having the "rounded" edge which is shown as flag $F_a$. The "signal" lead is connected to the square or rectangular flag $F_b$. This convention makes it readily identifiable as to which lead is the ground lead and which is the signal lead when the connector is pushed home onto the terminal pins. Alternative identification means such as color coding or distinctive shaping are also possible.

FIG. 5 is a detailed view of the punched flags and the common carrier strip of the second embodiment. The two flags $F_a$ and $F_b$ are seen being connected by a single metallic strip $1_c$ and having scored break-off areas $8_a$ and $8_b$.

The center distance between the openings of the two flags, that is to say as between the center of $3_a$ and $3_b$, may, in one application, be a distance of 0.20 inches which is equal to the distance between centers of adjacent terminal pins on the backplane. The overall connector length and width is such that visible clearance is provided as between connectors adjacent to each other on the backplane. This facilitates the location and removal of specific wirepair connectors when maintenance and trouble shooting is required.

Referring to FIG. 6, it is seen that the two flags $F_a$ and $F_b$ have been encompassed by a plastic insulator 13 having an upper section $13_u$ and a lower section $13_d$, which is sealed around the flags (after breaking off the carrier strip $1_c$ of FIG. 5). Alternatively, the complete plastic cover may be molded in one piece around the flags.

In FIG. 6, the connector 13 has been pushed on terminal pins $12_a$ and $12_b$ such that the teeth $4_a$ and $4_b$ will make a solid biting connection with the terminal pins $12_a$ and $12_b$ respectively. This solid "bite" will be airtight and corrosion free, since the metallic teeth, $4_a$, $4_b$ are made harder than pins $12_a$, $12_b$ and the teeth will "flow" into the surface of pins $12_a$, $12_b$ which are relatively more ductile, though made of the same metal composition as the teeth to prevent electrochemical action.

The plastic connector cover 13 is made with two cut-outs $14_a$ and $14_b$ which coincide with the openings in the flags $F_a$ and $F_b$.

The break-off areas $8_a$ and $8_b$ are bent and severed after the placement and sealing of the plastic cover 13 is accomplished.

Before the plastic covers $13_u$ and $13_d$ are placed, the cable 20 is separated into the ground lead $20_g$ and $20_s$ (signal lead) which are connected by soldering or brazing, etc. to the metallic portion of the flags $F_a$ and $F_b$ (FIG. 5). After this connection is made then the upper and lower plastic cover plates of the connector 13 are sealed together. Or alternatively, a single plastic cover may be molded around the flags. After breaking off the common carrier the finished connector can be "pushed home" onto the appropriate backplane terminal pins. Since the thickness dimension of the connector is small relative to the length of the backplane terminal pins, a plurality of connectors can be stacked, one over the other, making a neat orderly arrangement whereby multiple pairs of wires are reliably connected to the same pair of backplane pins. Under the old wire-wrap technique, one set of wires would be buried by another set of wires making test and maintenance most difficult and practically impossible to disconnect or rearrange.

As indicated in the prior description, the process of manufacture involves taking a thin sheet of metal strip, punching it to form a series of flag-pairs connected by a common carrying strip (FIGS. 1 and 5), punching an opening having a plurality of radially-oriented teeth (FIG. 1) or punching two-pair of opposing teeth (separated by a gap) as in FIG. 5, then scoring a break-off line ($8_a$ and $8_b$ of FIGS. 1, 5).

In the first described embodiment (FIGS. 1, 2, 3), each flag is stamped with a curved edge and a straight edge which are then bent at 90° to the plane of the flag. After attachment of the lead wires, encapsulation of the connectors, the carrier strip is broken off.

In the second described embodiment, one flag of a pair is stamped with rounded edges while the other flag of the pair is made with square edges. After the two wire leads are connected to their respective flags, the flag pair is covered by insulated covers (having openings permitting exposure of the tooth area) after which the common carrier strip is broken off. Thus, a connector is presented, which consists of two flags with metal teeth which can be pushed "home" onto two adjacent terminal pins of the backplane. The small projecting teeth provided on the inside will be deflected as the connector flags are pushed onto the terminals and the teeth will bite into the pins to make a solid reliable connection, which will maintain low contact resistance and be free from corrosion at the interface.

The fabrication technique lends itself to automatic production techniques since such pairs of flag connectors can be produced very quickly and economically by punching large series of them from thin sheet metal. Thus automatic machinery may be set up to punch flags, connect wires, and encapsulate flag-pairs to provide multitudes of such connectors economically and rapidly.

It is of relative interest to note that on a single backplane grid there may typically be 3500 to 4000 single wire paths which have connections to a terminal pin at either end. likewise, there may typically be 3–4000 twisted pair cables having two-wire terminations at each end which must be cconnected to differently located pairs of backplane pins on the backplane grid. Further, sometimes several pairs of cable will coincide locationally for connection on the same pair of backplane pins.

Since each set of adjacent-pair of backplane terminal pins may be stacked up with three, four or more push-on connectors, this "nestability" or "stacking" feature provides for multiple reliable connections in an orderly fachion which connection can be located visibly and separated or rearranged, thus permitting efficient trouble shooting and repair work.

The testing and use of the above-type described connectors, when pushed on to the terminal pins of a backplane, has shown that they generally provide a much lower value of contact resistance than do wire-wrap terminations and further, a multitude of each terminations were shown to have less average variation in contact resistance during use than did a similar set of wire-wrap terminations.

In summary, there is provided a simple inexpensive connector for connecting twisted pair or coaxial cable wires (and which is equally useful for single wires) to the backplane pins of an electrical assembly. The connector has versatile features of "nestability" with reliable low-impedance contact interfaces together with the capability of economic fabrication by automatic machine techniques.

The hereinbefore described connector is illustrative and exemplary of the invention and is not limited merely to the described embodiments but may also be embodied in other configurations according to the following claims:

What is claimed is:

1. An electrical connector for connecting a pair of wires, each wire carrying a different voltage level, to adjacent terminal pins on a backplane, comprising:

a. a pair of conductive flags, spaced a predetermined distance apart;

b. an opening centrally located in each flag of said pair of conductive flags;

c. a pair of bifurcated strips within each of said central openings to provide teeth for biting into the surface of a terminal pin inserted through said opening;

d. an insulating cover which integrally provides a hermetic seal to said pair of conductive flags and said pair of wires while rigidly maintaining said flags a predetermined distance apart, said insulating cover having openings oriented to expose the central opening of each flag and the ends of the teeth within the opening of each of said flags;

e. said insulating cover having one end provided with a shape distinguished from the shape of the other end to readily identify one wire of the twisted pair from the other wire in order to distinguish the level of each wire in the pair of wires, thus to reliably insure the proper voltage orientation and proper connection of the wires when connected on the terminal pins of said backplane;

f. each of said openings in said hermetically insulating cover providing sufficient exposed area about the central openings of the flag and about the teeth therein to permit bending of said teeth into contact against said backplane pins.

2. An electrical connection means for connecting a pair of wires to a pair of adjacent terminal pins on the backplane of an electrical assembly comprising:

a. a pair of metallic flags each of which has a central perforated opening with bifurcated teeth pointing inwardly toward the central part of the opening, said flags being held spatially, one from the other, so that the distance between openings of the two flags exactly matches the distance between adjacent terminal pins on the said backplane;

b. insulating means hermetically sealing and rigidly holding said pair of flags a preset distance apart and having central recesses which permit exposure of said bifurcated teeth, said recesses providing sufficient space to permit said teeth to bend into cutting contact with said backplane terminal pins;

c. and wherein said insulating means is formed with an external non-symmetrical shape to permit instant recognition as to which wire of said pair of wires is connected to which terminal of said pair of terminals.

* * * * *